US007230180B2

(12) United States Patent
Frank

(10) Patent No.: US 7,230,180 B2
(45) Date of Patent: Jun. 12, 2007

(54) MULTI-STRAND STEEL CABLE

(75) Inventor: Torsten Frank, Berlin (DE)

(73) Assignee: Concord Raumnetz GmbH, BErlin (DE)

( * ) Notice: Subject to any disclaimer, the term of this patent is extended or adjusted under 35 U.S.C. 154(b) by 0 days.

(21) Appl. No.: 11/367,201

(22) Filed: Mar. 3, 2006

(65) Prior Publication Data

US 2006/0204752 A1 Sep. 14, 2006

(30) Foreign Application Priority Data

Mar. 4, 2005 (DE) ..... 10 2005 011 357

(51) Int. Cl.
*H01B 7/00* (2006.01)

(52) U.S. Cl. ..... 174/36; 174/110 R

(58) Field of Classification Search ..... 174/102 R, 174/102 C, 102 E, 103, 105 R, 107, 108, 174/126.1, 126.2, 128.1
See application file for complete search history.

(56) References Cited

U.S. PATENT DOCUMENTS 2,167,098 A * 7/1939 Wells ..... 174/103
3,665,095 A * 5/1972 Seguin ..... 174/107
3,681,911 A * 8/1972 Humphries ..... 57/217
3,772,454 A * 11/1973 Donecker et al. ..... 174/113 R
3,800,522 A * 4/1974 Hughes et al. ..... 57/215
4,196,307 A * 4/1980 Moore et al. ..... 174/47
4,458,107 A * 7/1984 Heroux ..... 174/127
4,568,797 A * 2/1986 Binder et al. ..... 174/128.1
4,571,453 A * 2/1986 Takaoka et al. ..... 174/110 A
5,496,969 A * 3/1996 Blackmore ..... 174/113 R
6,321,520 B1 * 11/2001 De Angelis ..... 57/223
6,376,775 B1 * 4/2002 Leijon et al. ..... 174/128.1
6,424,768 B1 * 7/2002 Booth et al. ..... 385/102
7,036,298 B2 * 5/2006 Honda ..... 57/214

FOREIGN PATENT DOCUMENTS

DE 26 30 417 1/1978

* cited by examiner

*Primary Examiner*—William H. Mayo, III
(74) *Attorney, Agent, or Firm*—Cohen Pontani Lieberman & Pavane LLP

(57) ABSTRACT

A multi-strand steel cable includes steel strands jacketed with plastic fibers, where the plastic fiber jacketing is melted onto the steel strands by a thermal treatment. The steel cable has a core formed by an unjacketed steel strand, and the core is surrounded by jacketed steel strands. The heat supplied during the thermal treatment is introduced in such a way that certain areas of the steel strands which have been jacketed with the melted plastic fibers, namely, the areas adjacent to the core, are melted onto the outside circumference of the core.

3 Claims, 1 Drawing Sheet

MULTI-STRAND STEEL CABLE

BACKGROUND OF THE INVENTION

1. Field of the Invention

The invention pertains to a multi-strand steel cable, having steel strands jacketed with plastic fibers, where the plastic fiber jacketing is melted onto the steel strands by a thermal treatment. The invention also pertains to a process for producing a multi-strand steel cable.

2. Description of the Related Art

DE 26 30 417 A1 describes a steel cable in which the plastic fiber jacketing of the steel strands has been thermally treated in such a way that at least certain areas of the jacketing are melted onto the individual steel strands. The steel cable itself is then formed by combining the individual strands which have been treated in this way. It is proposed as an alternative that a cable be formed first out of unjacketed steel strands and that the cable as whole then be provided with a plastic fiber jacket, which is then thermally treated so that at least partial melting occurs. In both variants, the thermal treatment is preferably carried out by means of induction.

FIG. 1 shows a seven strand cable according to DE 26 30 417, wherein each strand has individual wires 1 surrounded by a plastic fiber jacket 2 with a melted on area 3, an outer area 4, and a transition area 5.

SUMMARY OF THE INVENTION

An object of the invention is to improve the durability of steel cable of this type having of multiple strands.

According to the invention, the steel cable has a core, which consists of an unjacketed steel strand, and this core is surrounded by the jacketed steel strands. Heat supplied during the thermal treatment is introduced in such a way that the areas of the plastic fiber jackets of the steel strands which are in contact with the core are melted onto the core.

The following procedure is used to produce the multi-strand steel cable:

jacketing a steel strand with plastic fibers;

subjecting the jacketed steel strand to a thermal treatment so that the plastic fibers are melted onto the steel strand;

combining several of the steel strands which have been treated in his way and an unjacketed steel strand, which will form the core, to form a steel cable; and subjecting the steel cable to a thermal treatment, during which heat is introduced in such a way that certain areas of the steel strands which have been jacketed with the melted plastic fibers, namely, the areas adjacent to the core, are melted onto the outside circumference of the core.

In contrast to known steel cables, the steel cables produced in this way offer significant advantages in terms of strength and durability. The jacketing of the steel strands protects them against abrasion and corrosion. Because the melted plastic fibers are also bonded to the steel strand forming the core, the overall strength of the cable is significantly increased.

As in the state of the art, the thermal treatment of the individual steel strands and of the cable formed from them takes place by induction. The reason for this is that the heat produced by induction comes from the inside, which means that the heat transfer and thus the melting process can be controlled very precisely.

Other objects and features of the present invention will become apparent from the following detailed description considered in conjunction with the accompanying drawings.

It is to, be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
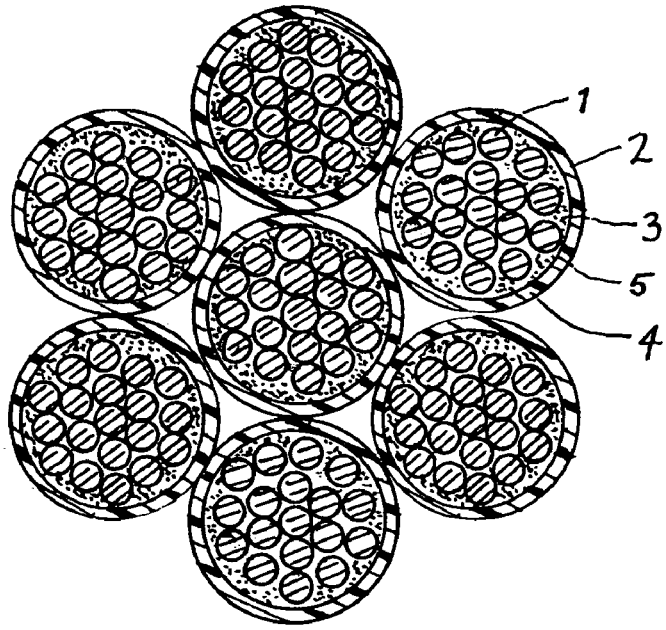
FIG. 1 (PRIOR ART)
FIG. 1 is a cross section of a steel cable according to the prior art.
Figure 2:
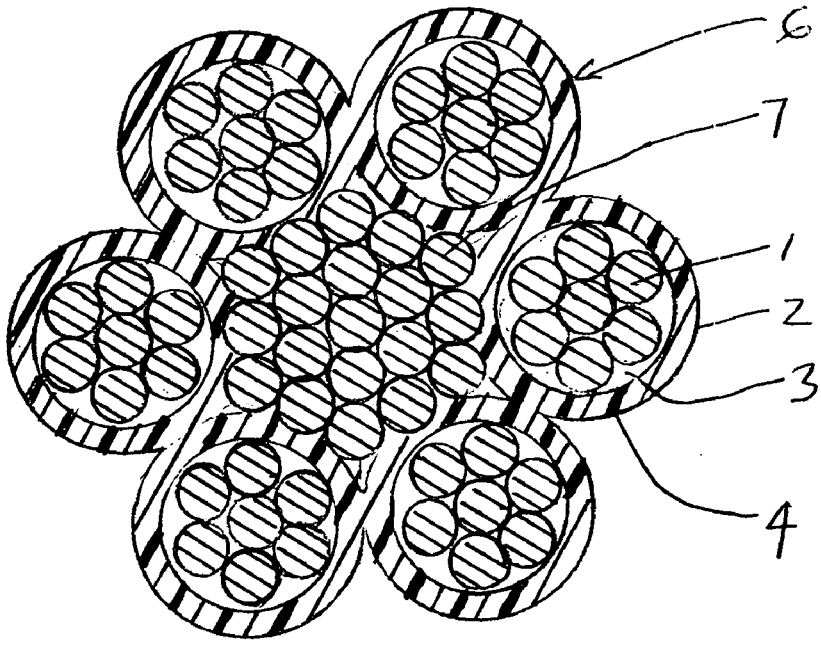
FIG. 2 is a schematic cross section of a steel cable according to the invention.

FIG. 2 shows an example of a cable according to the invention, which includes plurality of outer strands 6 surrounding a core 7 which has not been provided with its own jacket. Each outer strand 6 consists of a plurality of wires 1 surrounded by a jacket 2 of plastic fibers which has been thermally treated so that the fibers melt onto the wires to form a melted-on area 3. The outer areas 4 are melted onto the wires of the core 7 where they contact the wires of the core 7.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A multi-strand steel cable comprising:

a core consisting of a plurality of wires without a jacket; and a plurality of jacketed steel strands surrounding the core, each strand comprising a plurality of wires surrounded by a plastic fiber jacket which is melted onto the wires in the strand, each jacket having an area which is in contact with the core, said area being melted onto the core.

2. A method of producing a multi-strand steel cable, said method comprising:

providing each of a plurality of steel strands with a jacket of plastic fibers;

subjecting each of the strands to a thermal treatment so that the plastic fibers are melted onto respective said strands to form jacketed steel strands;

providing a core consisting of an unjacketed steel strand;

surrounding the core with a plurality of said jacketed strands to form a steel cable wherein each jacket has an area adjacent to the core; and subjecting the steel cable to a thermal treatment so that the adjacent areas of the jacketed strands melt onto the core.

3. The method of claim 2 wherein the thermal treatment is performed by induction.

* * * * *